US008950634B2

(12) United States Patent
Boes et al.

(10) Patent No.: US 8,950,634 B2
(45) Date of Patent: Feb. 10, 2015

(54) BELLOWS PUMP SYSTEM

(75) Inventors: Erwin Boes, Wichen (NL); Jeroen D. De Regt, Oss (NL)

(73) Assignee: MeadWestvaco Calmar, Inc., Richmond, VA (US)

( * ) Notice: Subject to any disclaimer, the term of this patent is extended or adjusted under 35 U.S.C. 154(b) by 0 days.

(21) Appl. No.: 13/994,284

(22) PCT Filed: Dec. 21, 2011

(86) PCT No.: PCT/US2011/066423
§ 371 (c)(1),
(2), (4) Date: Jun. 14, 2013

(87) PCT Pub. No.: WO2012/088239
PCT Pub. Date: Jun. 28, 2012

(65) Prior Publication Data

US 2013/0336824 A1 Dec. 19, 2013

Related U.S. Application Data

(60) Provisional application No. 61/425,340, filed on Dec. 21, 2010.

(51) Int. Cl.

| | |
|---|---|
| ***B65D 37/00*** | (2006.01) |
| ***F04B 45/02*** | (2006.01) |
| ***B05B 11/00*** | (2006.01) |
| ***F04B 43/08*** | (2006.01) |

(52) U.S. Cl.
CPC ..... *F04B 45/02* (2013.01); *B05B 11/3033* (2013.01); *B05B 11/3047* (2013.01); *B05B 11/3066* (2013.01); *F04B 43/084* (2013.01); *B05B 11/3035* (2013.01)
USPC ..... 222/207; 92/99; 417/472

(58) Field of Classification Search
CPC ..... B05B 11/0062; B05B 11/007; B05B 11/0075; B05B 11/04; B05B 11/048; B05B 11/30; B05B 11/3028; B05B 11/3033; B05B 11/3035; B05B 11/3066; F04B 43/084; F04B 45/02
USPC ..... 222/207, 209, 211, 214; 92/98 D, 99; 417/472, 480
See application file for complete search history.

(56) References Cited

U.S. PATENT DOCUMENTS

| | | | | |
|---|---|---|---|---|
| 2,083,156 | A * | 6/1937 | McCabe | 222/207 |
| 2,690,278 | A * | 9/1954 | Flavius | 222/207 |
| 2,808,966 | A * | 10/1957 | Hall et al. | 222/207 |
| 3,124,275 | A * | 3/1964 | Lake | 222/182 |
| 4,696,415 | A * | 9/1987 | Meshberg | 222/82 |

(Continued)

FOREIGN PATENT DOCUMENTS

WO WO2010/050772 5/2010

OTHER PUBLICATIONS

International Search Report for PCT/US11/66423 dated May 1, 2012.

*Primary Examiner* — Patrick M Buechner
(74) *Attorney, Agent, or Firm* — MeadWestvaco Intellectual Property Group

(57) ABSTRACT

A simplified pump system may include a bellow having a suction valve, a stem, and a fluid lock wherein the product flow into and out of a pump chamber formed by the bellow and stem is controlled by the suction valve and fluid lock.

12 Claims, 11 Drawing Sheets

(56) References Cited

U.S. PATENT DOCUMENTS

| | | | | | |
|---|---|---|---|---|---|
| 4,778,087 | A | * | 10/1988 | Desai | 222/449 |
| 5,110,051 | A | * | 5/1992 | Bennett | 239/327 |
| 5,120,148 | A | * | 6/1992 | Waters et al. | 401/264 |
| 5,205,441 | A | * | 4/1993 | Andris | 222/207 |
| 5,238,156 | A | * | 8/1993 | Andris | 222/207 |
| 5,544,789 | A | | 8/1996 | Gillingham | |
| 5,788,124 | A | | 8/1998 | Bougamont et al. | |
| 5,819,990 | A | * | 10/1998 | Cimentepe et al. | 222/207 |
| 6,805,267 | B2 | * | 10/2004 | Bougamont | 222/633 |
| 7,793,803 | B2 | | 9/2010 | Neerincx et al. | |
| 8,474,661 | B2 | * | 7/2013 | Carta | 222/153.13 |
| 2009/0110576 | A1 | | 4/2009 | Brouwer et al. | |
| 2011/0084099 | A1 | * | 4/2011 | Carta | 222/212 |
| 2012/0024904 | A1 | * | 2/2012 | Doulin et al. | 222/207 |

* cited by examiner

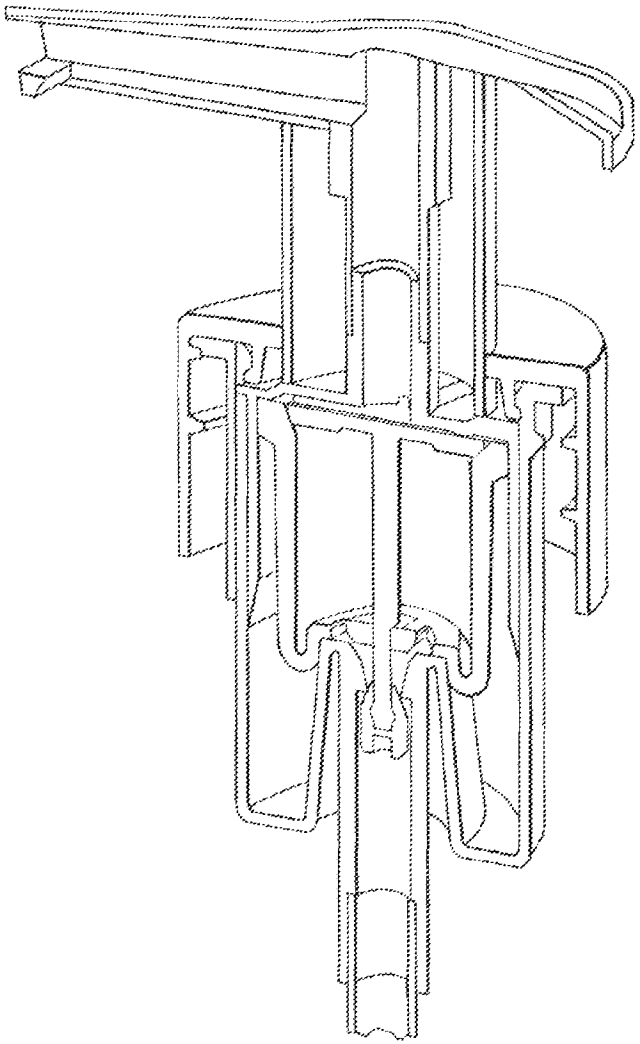
FIG.7
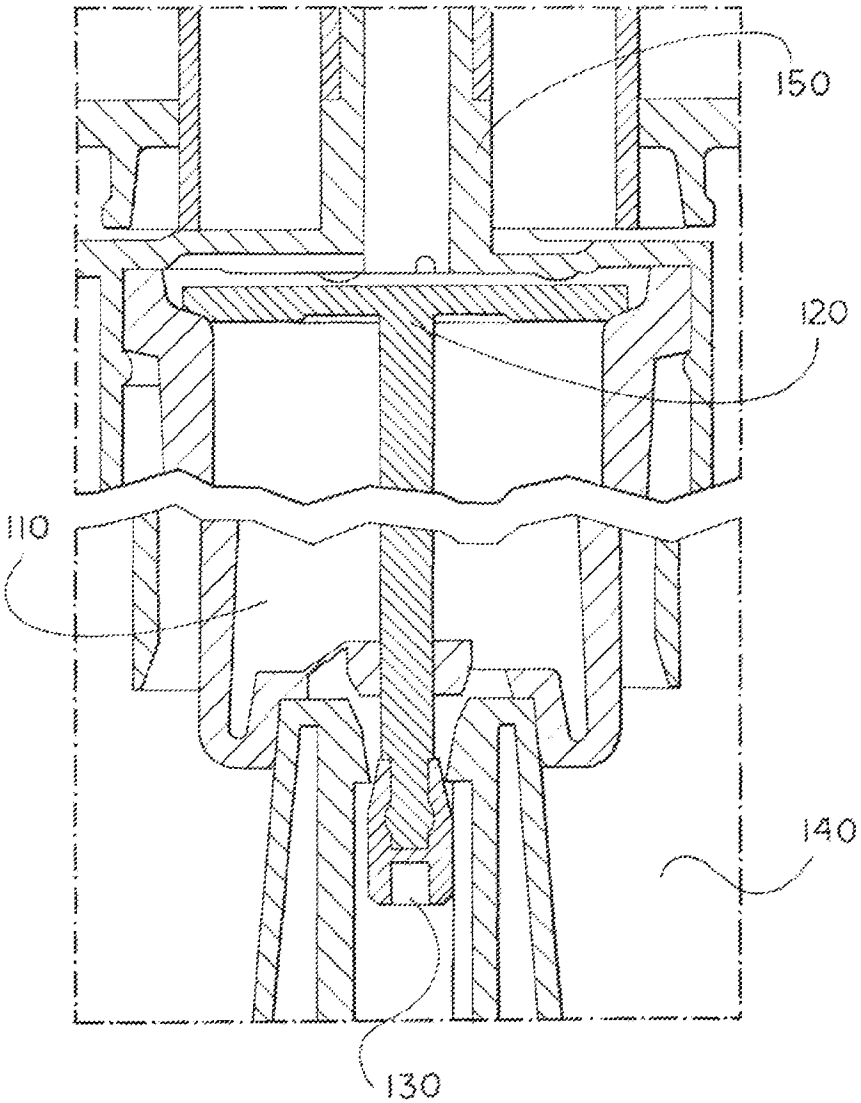

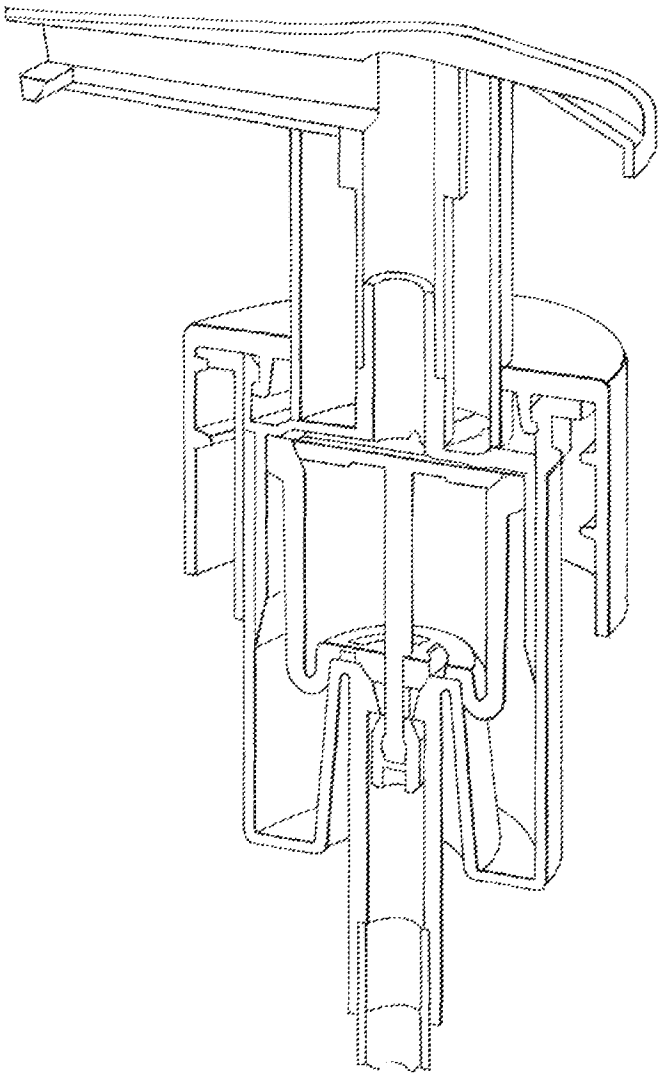
FIG.8
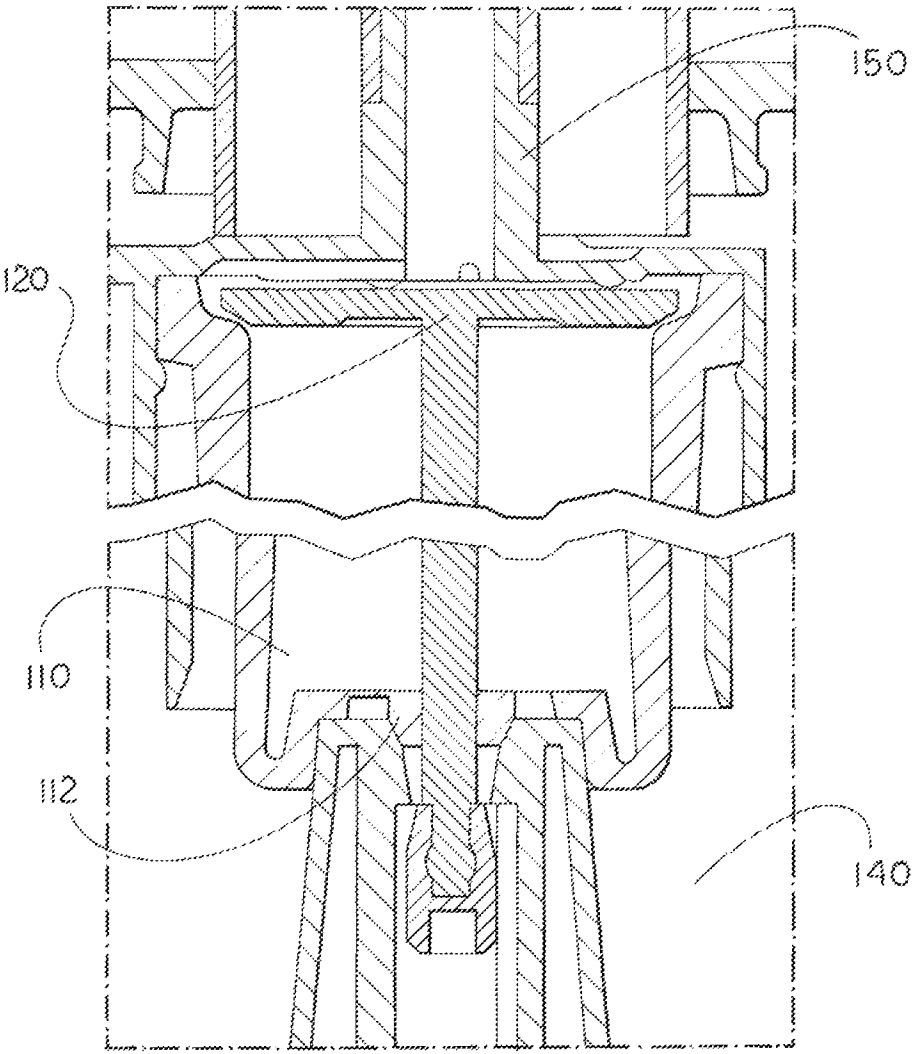

BELLOWS PUMP SYSTEM

CROSS-REFERENCE TO RELATED APPLICATIONS

This application claims the benefit of, and priority to, U.S. Provisional Application No. 61/425,340, entitled "PUMP DEVICES AND METHODS FOR USING THE SAME," filed 21 Dec. 2010, and incorporates the same herein by reference in its entirety.

BACKGROUND OF THE INVENTION

1. Field of the Invention

The present invention relates to pump devices and in particular to bellow-type pumps for dispensing fluids or other pasty products.

2. State of the Art

Pumps and pump devices are known. In addition, pumps using bellows systems as springs and pistons are known. For example, U.S. Pat. No. 7,793,803, which is incorporated by reference herein in its entirety, discloses a bellow-type pump and pump system which is known.

While various bellow-type pump systems are known, the use of bellows for new delivery requirements and improvements in such pumps are desirable.

BRIEF SUMMARY OF THE INVENTION

According to certain embodiments of the invention, a pump system may include a base and a guide combination having a bellow and a stem contained therein. A fluid seal may be attached to the stem on an end opposite that closest to the guide. The stem may interact with the bellow to form a compartment within the bellow wherein a fluid or product may be stored. The stem may seal against a portion of the bellow to seal the compartment from the guide. The stem may also disengage from the bellow to allow fluid to pass from the bellow compartment, by the stem, and through the guide. The fluid lock may seal against a portion of the base and prevent fluid from moving from a container attached to the pump system into the bellow compartment. The fluid lock may be disengages from the base allowing fluid to pass from a container and into the bellow compartment during a return stroke of the pump system.

According to various embodiments of the invention, the stem, bellow, and fluid seal may be configured as desired to provide a bellow container having particular dimensions or to facilitate operation of a pump system according to embodiments of the invention. For example, the stem may be configured with a flat head, a concavely shaped head, a convexly shaped head, or any other desired configuration to facilitate interaction with a guide, a bellow, or both a guide and bellow.

According to certain embodiments of the invention, a pump system may be fitted with a pump head and connected to a container such that fluid or other product in the container may be pumped from the container and delivered through the pump head.

According to some embodiments of the invention, a pump system may be connected to a bottle. In others, a pump system may be connected to a bag or pouch. In still others, a pump system according to embodiments of the invention may be connected to a tube. Other containers may also be fitted to a pump system according to embodiments of the invention such that the pump system may deliver fluid from a container fitted thereto to an exterior of the container.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

FIG. 7 illustrates an assembled pump system according to various embodiments of the invention;

FIG. 8 illustrates an assembled pump system according to various embodiments of the invention;

DETAILED DESCRIPTION OF THE INVENTION

According to embodiments of the invention, a pump system may include a bellow, a stem, and a fluid seal acting together to form a pump for moving a product, such as a liquid or pasty material, from a container to a location outside of the container for use. In some embodiments of the invention, a bellow and stem may form a bellow chamber for holding a product and the stem may seal against the bellow until such time that the pump system is actuated when the seal between the bellow and stem may be broken, allowing product contained in the bellow chamber. In certain embodiments of the invention, the fluid seal may be fitted with or attached to the stem such that as the stem moves, the fluid seal is seated or unseated, thereby blocking fluid flow into a bellow chamber or allowing fluid to flow therethrough when a vacuum or suction force is applied to a fluid in a container.

Figure 1:
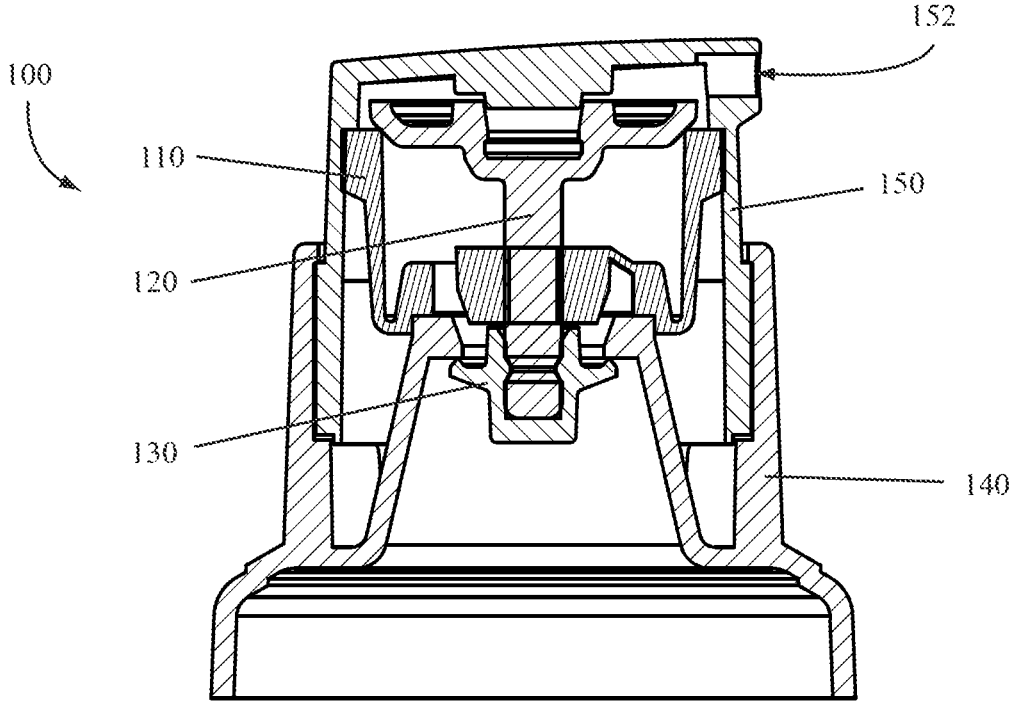
FIG. 1 illustrates a cross-sectional view of a pump system according to embodiments of the invention.
Figure 2:
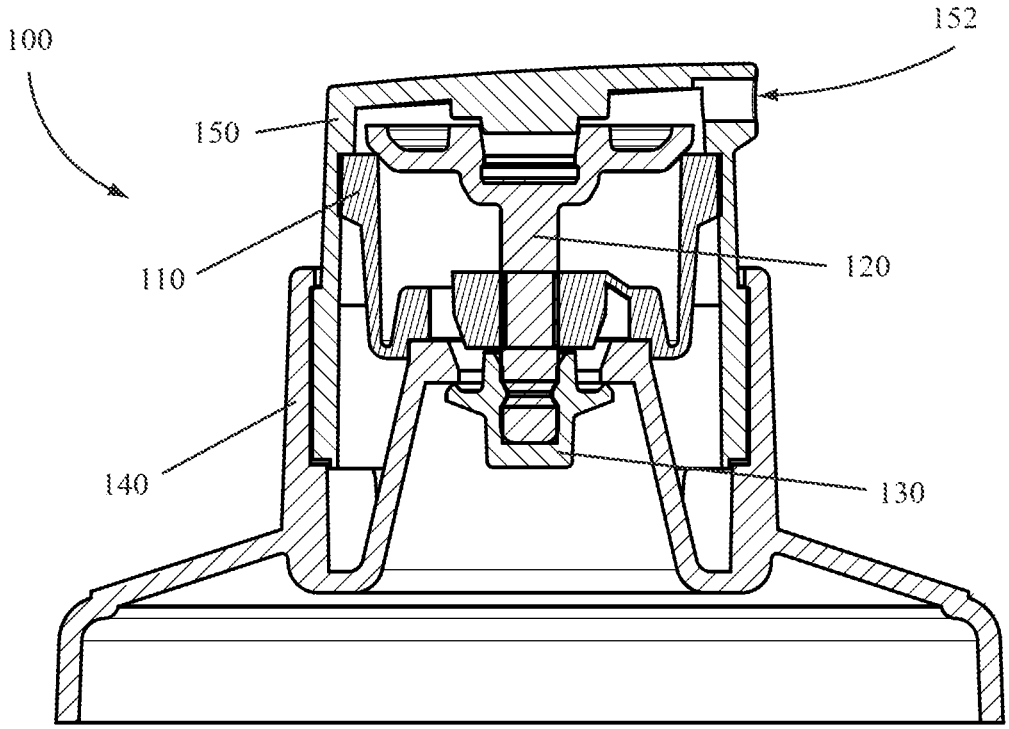
FIG. 2 illustrates a cross-sectional view of a pump system according to embodiments of the invention.
Figure 3:
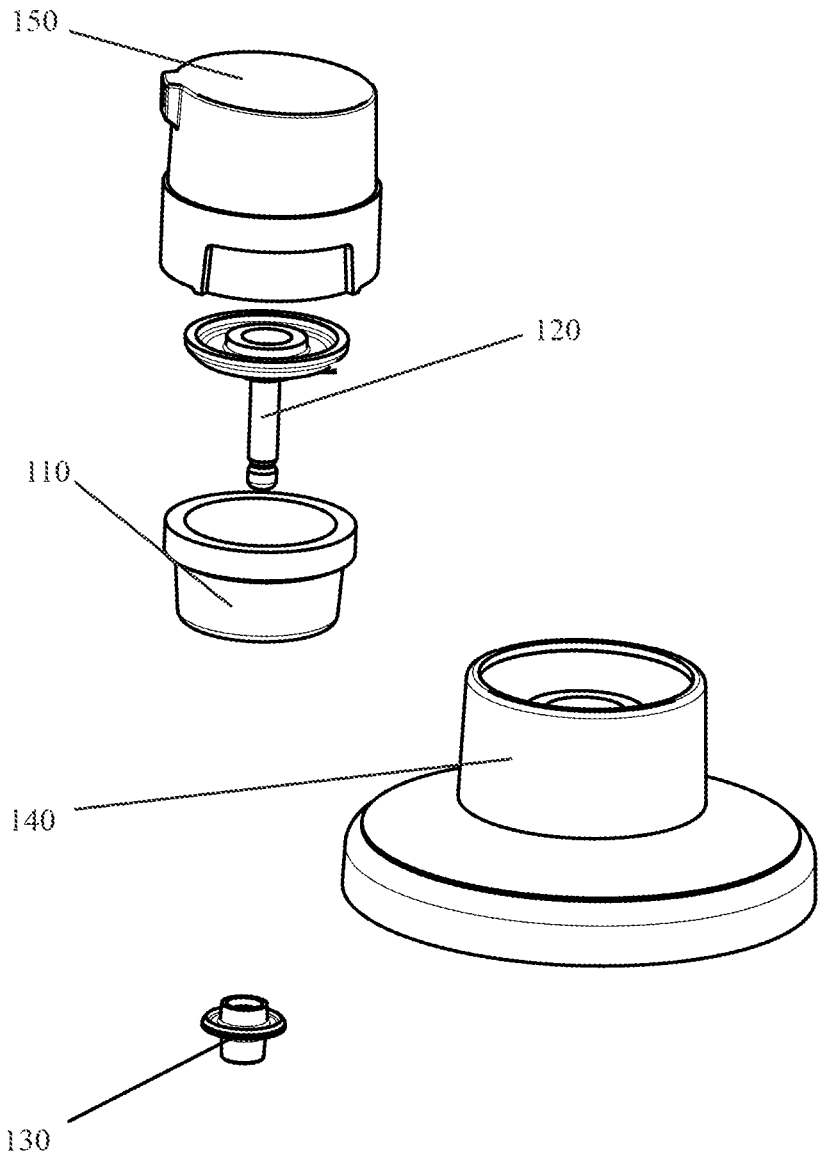
FIG. 3 illustrates a blown-apart view of various components of a pump system according to various embodiments of the invention.
Figure 4:
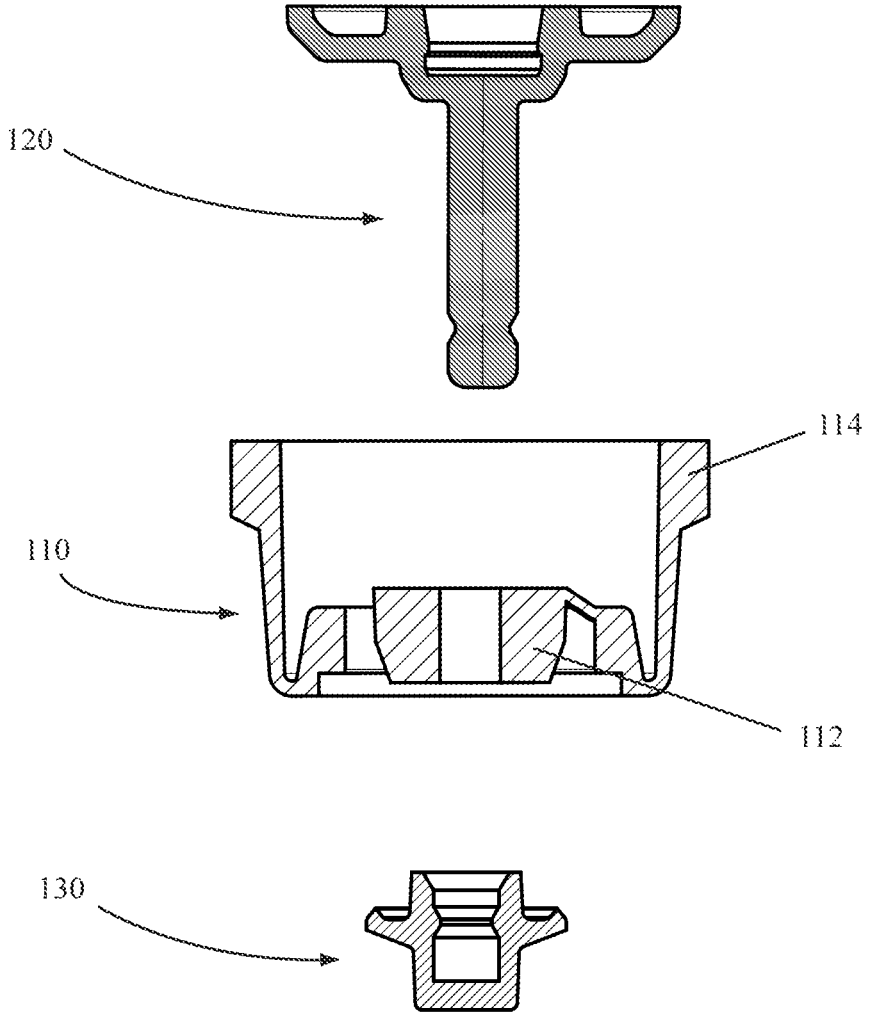
FIG. 4 illustrates a blown-apart view of a stem, bellow, and fluid seal according to various embodiments of the invention.
Figure 6:
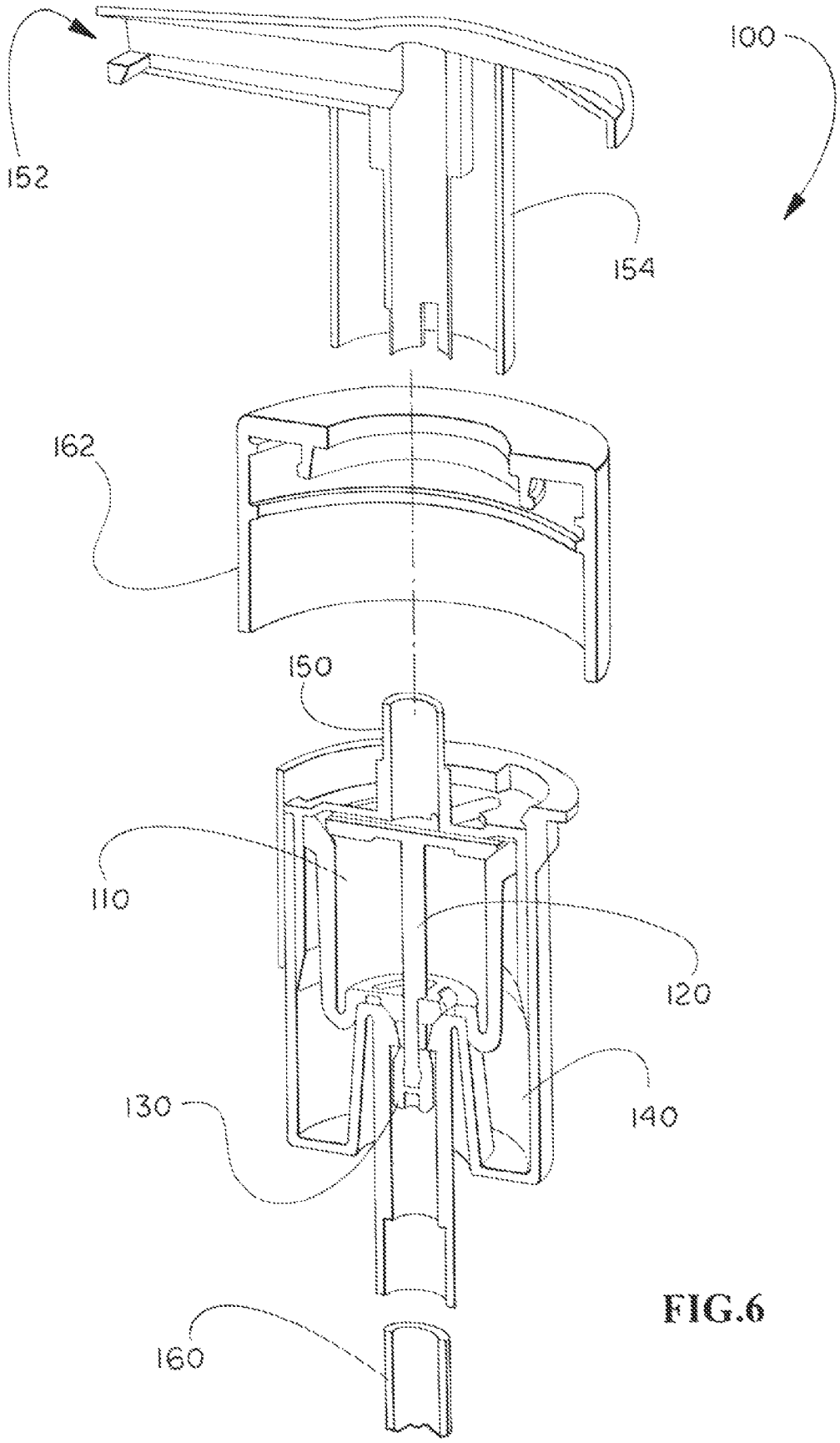
FIG. 6 illustrates a cross-sectional, blown-apart view of a pump system according to various embodiments of the invention.

According to various embodiments of the invention, a pump system 100 may include a bellow 110, a stem 120, a fluid lock 130, a base 140, and a guide 150 as illustrated in FIGS. 1, 2, and 6. In some embodiments of the invention, the guide 150 may also serve as a pump head.

According to various embodiments of the invention, a bellow 110 may be made of a silicon material. In other embodiments, a bellow 110 may be made of any desirable material and such material may be selected to be compatible with a product which will be pumped through the bellow 110 during use of the pump system 100. Some other materials that may be used to construct, mold, or otherwise form a bellow 110 include TPU, TPE, or other elastomeric polymer materials.

Figure 5:
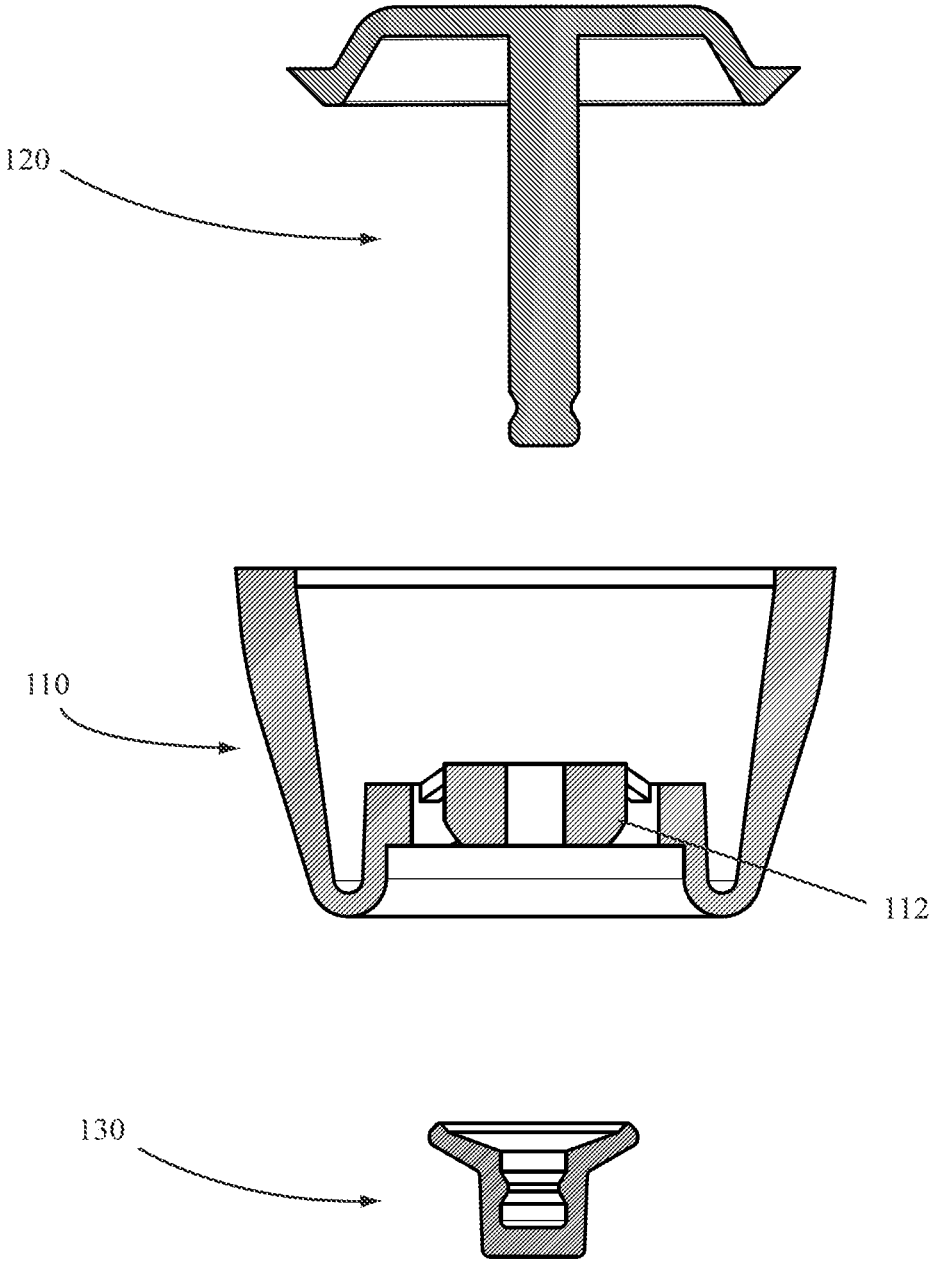
FIG. 5 illustrates a blown-apart view of a stem, bellow, and fluid seal according to various embodiments of the invention.

A bellow 110 according to embodiments of the invention may also take on varying shapes and sizes. The size of a bellow 110 may be adjusted to accommodate an amount of product which is desired for dispensing from the pump system 100. In addition, the bellow 110 may be shaped or constructed to provide certain actuating forces and return forces based on the thickness of the walls, shapes of the walls, and other characteristics of the bellow 110. Examples of differently shaped bellows 110 are illustrated in the Figures. For example, the bellow 110 illustrated in FIGS. 1 through 4 is different than the bellow 110 illustrated in FIG. 5 and the bellow 110 illustrated in FIG. 6.

According to various embodiments of the invention, a bellow 110 may include a suction valve 112 which may move during the actuation stroke of a pump system 100 and during the return stroke following actuation of the pump system 100. The suction valve 112 may be attached to the body of the bellow 110 by legs, arms, or other configurations which include gaps between the suction valve 112 and the remainder of the bellow 110 such that product may pass into the bellow 110 when the pump system 100 is in use.

Bellows 110 according to embodiments of the invention may also include an upper lip 114 which contacts a guide 150 any may be moved by the guide 150 during actuation of a pump system 100. In addition, portions of the upper lip 114 of a bellow 110 may interact with portions of the stem 120 to form a valve or seal a compartment or pump chamber between an interior of a bellow 110 and the stem 120.

A stem 120 according to various embodiments of the invention may be configured in any desired shape. A stem 120 may also be made of any desirable material. For example, a stem 120 may be made of a moldable plastic or resin such as polypropylene or other material.

According to embodiments of the invention, a stem 120 may include a top portion configured to interact with an upper portion or upper lip 114 of a bellow 110, a neck extending from the top portion to an end portion which may be configured to attach to or mate with a fluid lock 130. The top portion may be configured in any desired shape to provide the characteristics desired for a pump system 100. A portion of the neck may pass through a hole in a suction valve 112 of a bellow 110 and the end portion may extend outside the bellow 110 as illustrated in FIGS. 1, 2, and 6. The end portion of the stem 120 may be connected to, mated with, or otherwise attached to a fluid lock 130 as illustrated in the various Figures.

A fluid lock 130 according to various embodiments of the invention may be configured in any desired shape and made of any desired material. In some embodiments, a fluid lock 130 may be made of a moldable polymer or resin.

A fluid lock 130 may attach to an end portion of a stem 120 which projects through a suction valve 112 of a bellow 110. In some embodiments of the invention, a fluid lock 130 is attached to an end portion of a stem 120 which passes through a base 140 as illustrated in FIGS. 1, 2, and 6. The attachment of a fluid lock 130 to a stem 120 may serve to hold a bellow 110 on a base 140 for assembly of a pump system 100. When assembled with a stem 120, a fluid lock 130 may seal against a portion of the base 140, forming a seal and closing access to an opening in the base such that liquid, fluid, or other product may not pass by the fluid lock 130 and into an interior space of the bellow 110.

While a fluid lock 130 is shown with various embodiments of the invention, a pump system 100 having no fluid lock 130 may also be used. In such embodiments, an alternative means for stopping fluid or product flow into the bellow 110 upon application of a force to a container may be needed. For example, an additional valve could be molded with or integrated with the base 140.

A base 140 according to various embodiments of the invention may be configured in any desirable shape or size. For example, the base 140 illustrated in FIG. 1 differs from the base 140 illustrated in FIG. 2 and in FIG. 6. A base 140 may include an opening in the base 140 through which product—such as a liquid or fluid—may pass during operation of the pump system 100. According to some embodiments of the invention, a suction valve 112 of a bellow 110 may seat in the opening, forming a seal therewith during actuation of a pump system 100 such that a fluid or product may not pass into an interior space of the bellow 110 during actuation. Following actuation, the suction valve 112 may unseat from the opening in the base 140 and allow fluid or product to enter an interior space of the bellow 110 until a fluid lock 130 engages and seals with the base 140, preventing additional fluid or product flow.

A base 140 according to various embodiments of the invention may also include additional features for securing a pump system 100 to a container. For example, a base 140 may include threads for attaching the base, and pump system 100, to a container having a threaded closure. A base 140 may also include lugs or bayonet closure mechanisms and features to secure the base 140, and the pump system 100, to a container. Other snap-fitment, plug-fitment, threaded closures, welds or other attachment systems may be incorporated with a base 140 to allow a pump system 100 to be attached to a container.

Figure 11:
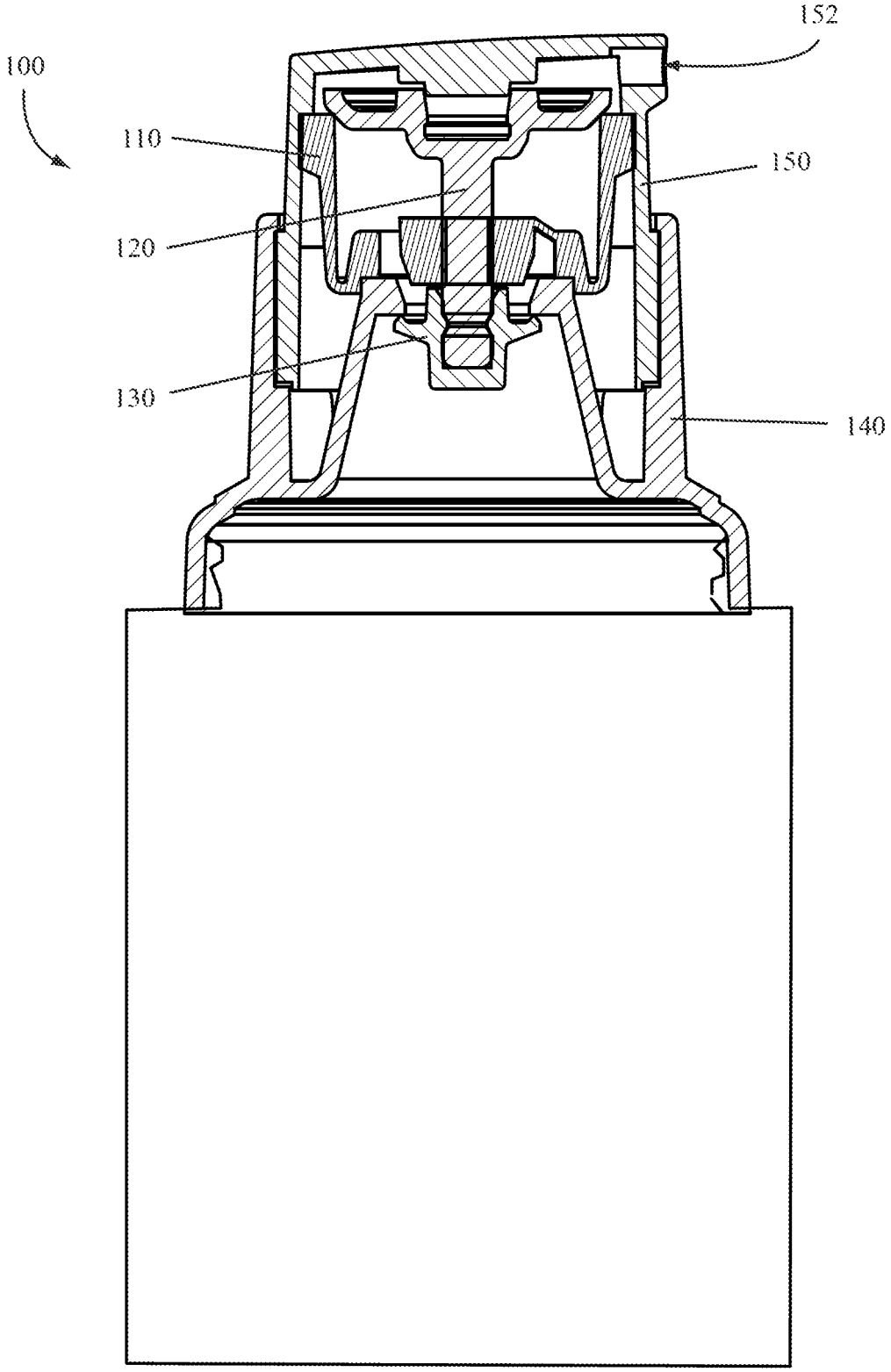
FIG. 11 illustrates an assembled pump system attached to a container according to various embodiments of the invention.
Figure 12:
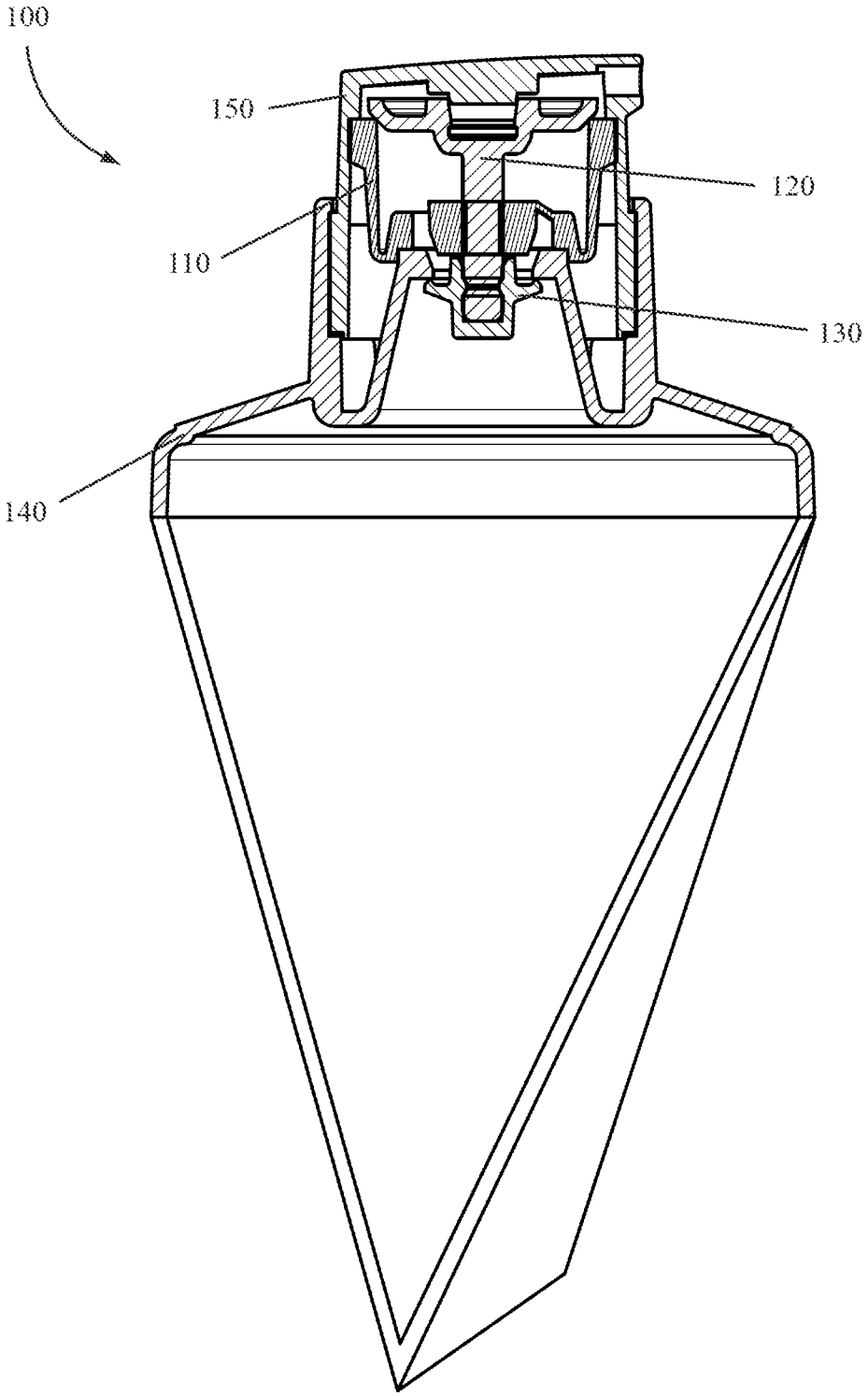
FIG. 12 illustrates an assembled pump system attached to a container according to various embodiments of the invention.

A pump system 100 according to embodiments of the invention may be configured to attach to any desired container. For example, a pump system 100 according to embodiments of the invention may be attached to a bottle using a conventional screw-type fitment system as illustrated in FIG. 11. Another example, illustrated in FIG. 12, shows a pump system 100 according to various embodiments of the invention attached to a tube wherein the base 140 may be welded or otherwise attached to an opening in the tube. Various embodiments of the invention may be attached to other conventional containers such as airless bottles, bags, tubes, or other containers from which a product may be drawn or pumped. In addition, attachment of a pump system 100 to a container may be by any conventional methods.

In some embodiments of the invention, a guide 150 may be configured as a pump head having a product flow path leading to an orifice 152 where product may exit the pump system 100. For example, in FIGS. 1 through 3, the guide doubles as a pump head. In other embodiments, such as that illustrated in FIGS. 6 through 10, a pump head 154 may be snapped to, fitted with, or otherwise connected to a guide 150 such that a product passing through the guide 150 flows into the pump head 154 and out an orifice 152. Other components, guides, product flow paths, or devices may be added to various embodiments of the invention to facilitate product flow from a bellow chamber to a desired location.

According to certain embodiments of the invention, a pump system 100 may be attached to an airless type container or a container which may collapse on itself during use. For example, the pump systems 100 illustrated in FIGS. 1 through 3 may be attached to an airless system such as an airless bottle, bag, or tube. In other embodiments of the invention, a pump system 100 may also include a dip tube 160 as illustrated in FIG. 6 for attachment of the pump system 100 to a conventional, vented container. In some embodiments of the invention, a dip tube 160 may be attached to or fixed with a base 140.

FIG. 6 also illustrates an attachment mechanism 162 which may be fitted with a pump system 100 to facilitate attachment of a pump system 100 with a container as desired. The attachment mechanism 162 may include threads, lugs, snap-fitments, or other features to attach a pump system 100 to a container having a particular fitment system. The attachment mechanism 162 may also be of different sizes such that a pump system 100 may be configured to fit on various sized containers by changing the attachment mechanism 162 rather than other components of the pump system 100.

According to some embodiments of the invention, one or more locking features may be added to a pump system 100 to allow a user to lock the pump system 100 and prevent or allow actuation of the pump system 100 as desired.

FIGS. 7 through 10 illustrate a pump system 100 according to embodiments of the invention during operation or actuation of the pump system 100. The operation of the pump system 100 illustrated in FIGS. 7 through 10 is representative of the operation of pump systems 100 according to embodiments of the invention. However, the description of the operation of the pump system 100 illustrated in FIGS. 7 through 10 is not meant to be limiting and it is understood that pump systems 100 according to embodiments of the invention may operate in different ways and such operation may be dependent upon the configuration of the components of a particular pump system 100.

A pump system 100 at rest according to various embodiments of the invention is illustrated in FIG. 7. The pump system 100 includes a base 140, a bellow 110 resting on a portion of the base 140 and surrounding an opening in the base 140. A top portion of a stem 120 rests on a portion of the bellow 110 near an upper lip 114 of the bellow 110 and a neck of the stem 120 extends through an interior of the bellow 110, through an opening in the suction valve 112 of the bellow 110 and through the opening in the base 140. A fluid lock 130 is attached to or mated with an end portion of the stem 120 and the fluid lock 130 seals against the base 140 plugging the opening in the base 140. In the at rest position, the suction valve 112 of the bellow 110 is not sealed against the base 140.

An upper lip 114 of the bellow 110 contacts a guide 150. A space exists between the guide 150 and the stem 120 such that the guide 150 is not in contact with the stem 120. A product flow path through the guide 150 is in communication with the space between the stem 120 and the guide 150.

During the initial actuation of the pump system 100 illustrated in FIG. 7, forces applied to the pump head 154 act on the guide 150, moving the guide 150 such that the guide 150 pushes the upper lip 114 of the bellow 110 and unseats the stem 120 from the bellow 110 as illustrated in FIG. 8. In addition to unseating the stem 120 from the bellow 110, the guide 150 interacts with the stem 120, pushing the stem 120 such that the neck portion of the stem moves the suction valve 112 into a seated position with the base 140 such that the opening in the base 140 is sealed by the suction valve 112. The fluid lock 130 is also moved or unseated from the base 140 by the movement of the stem 120 as illustrated in FIG. 8. Movement of the bellow 110 collapses the bellow 110 or rolls the bellow 110 as known and movement of the stem 120 decreases the size of the compartment or pump chamber formed between the stem 120 and the interior of the bellow 110. The decrease in the compartment or pump chamber size forces product from within the pump chamber though the space between the top portion of the stem 120 and the bellow 110 and out the product flow path. Product within the pump chamber may not flow back into the container through the opening in the base 140 because the suction valve 112 is sealed to the base 140 during actuation.

A stem 120 or a guide 150 of a pump system 100 according to embodiments of the invention may include bumps, ridges or other features to allow a product or fluid to pass between the stem 120 and the guide 150 during actuation. For example, the pump system 100 illustrated in FIG. 8 includes bumps on the guide 150 such that when the guide 150 interacts with the stem 120 paths between the guide 150 and the stem 120 remain which allow fluid or product exiting the bellow 110 to pass between the guide 150 and the stem 120 and exit through the product flow path of the guide 150.

Figure 9:
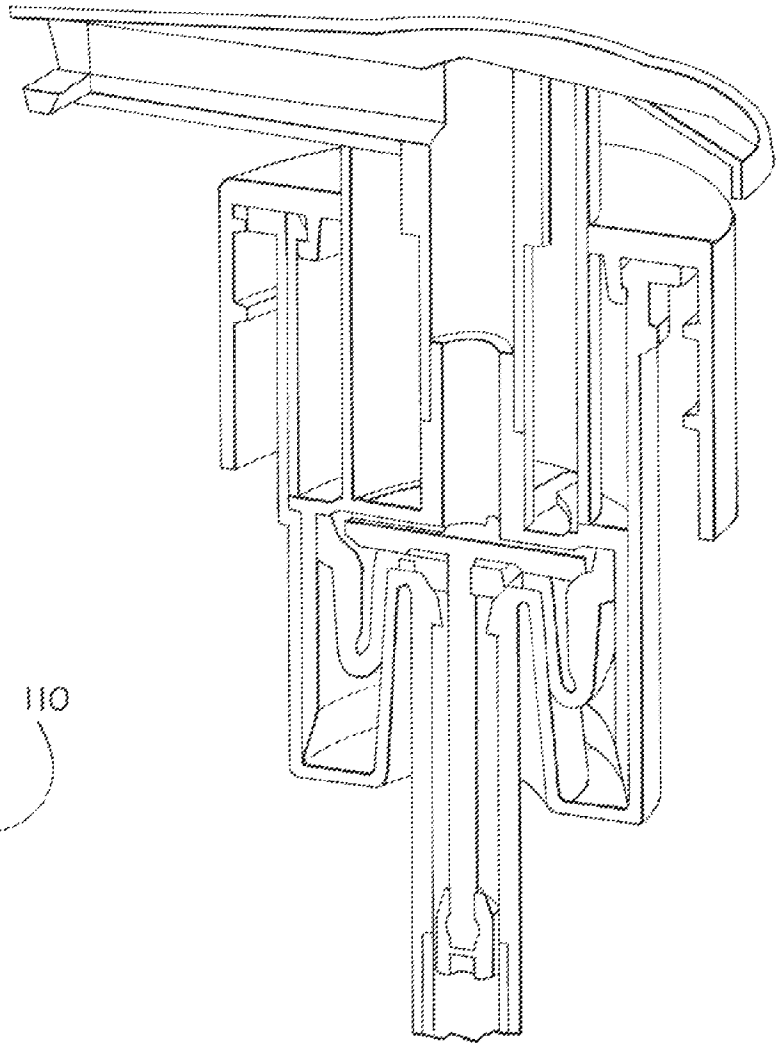
FIG. 9 illustrates an assembled pump system according to various embodiments of the invention.
Figure 9:
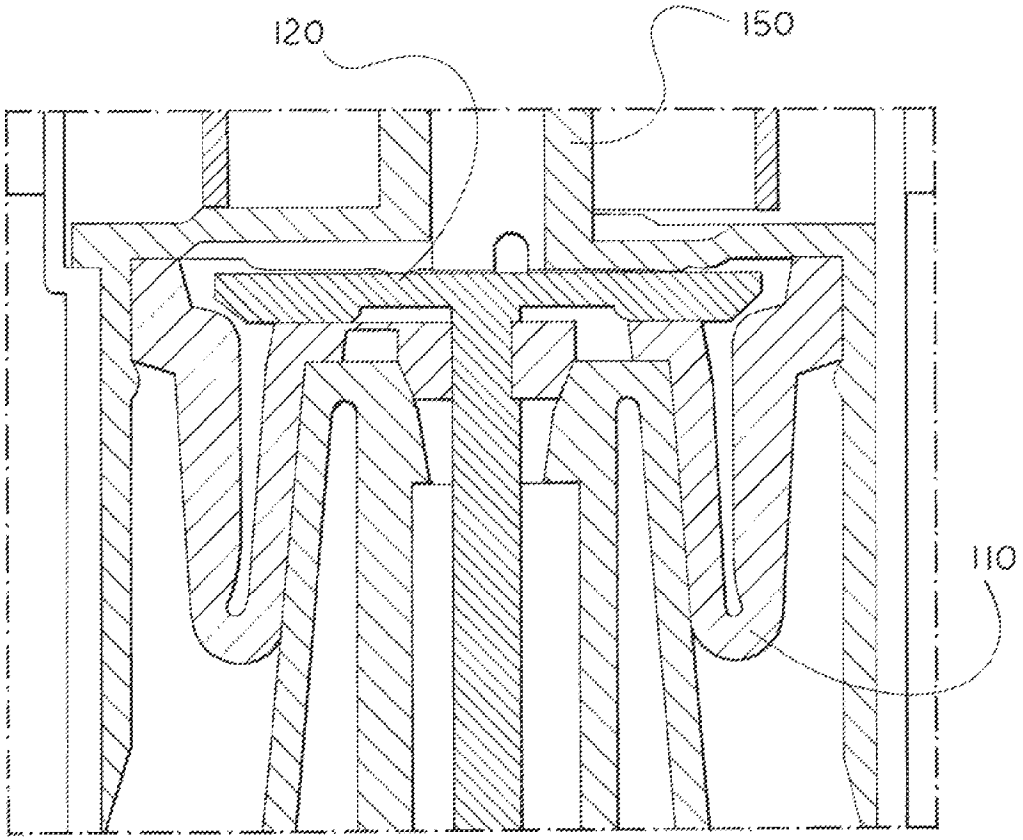

Actuation of the pump system 100 may be stopped when the stem 120 contacts a bottom portion of the bellow 110 as illustrated in FIG. 9. Alternatively, stops may be configured with a pump system 100 to limit the path of actuation. For example, stops may be integrated with a base 140 such that a guide 150 may only move a fixed distance before being stopped, ending actuation. In this manner, different pump sizes, or product distribution amounts, could be constructed by changing only the base 140 of a pump system 100 such that a different base 140 allowing different stroke lengths could be used to vary the pump capacity of the pump system 100 and the other components could be used with different pump system 100 dispensing ratios.

Figure 10:
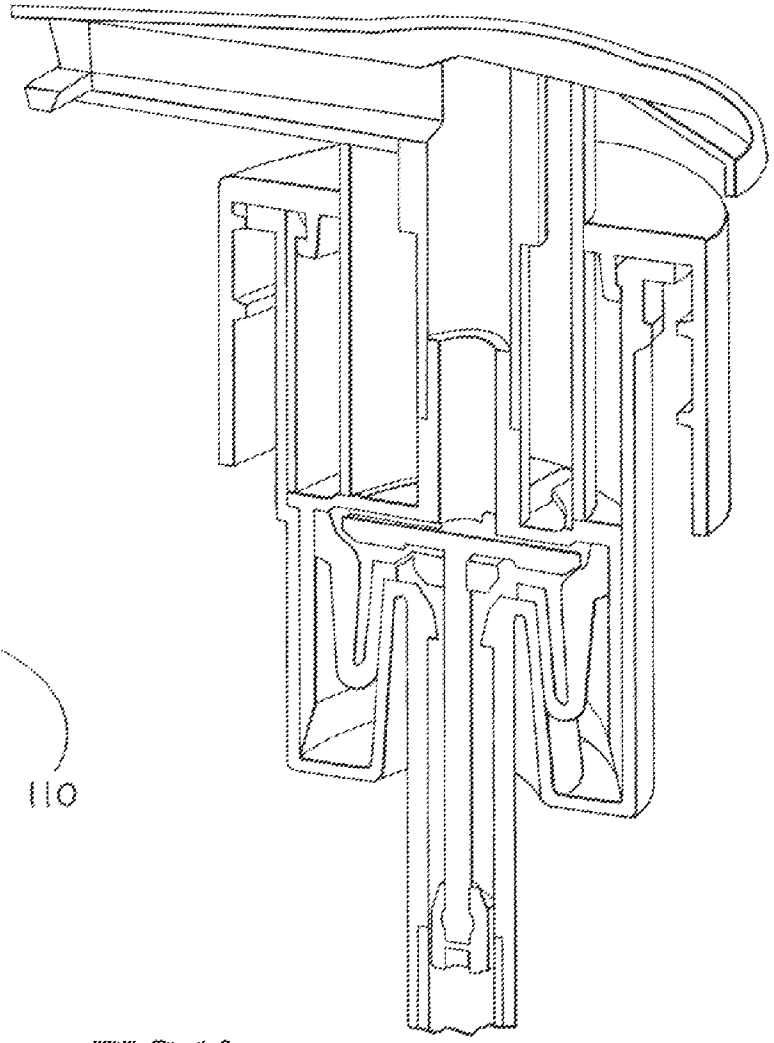
FIG. 10 illustrates an assembled pump system according to various embodiments of the invention.
Figure 10:
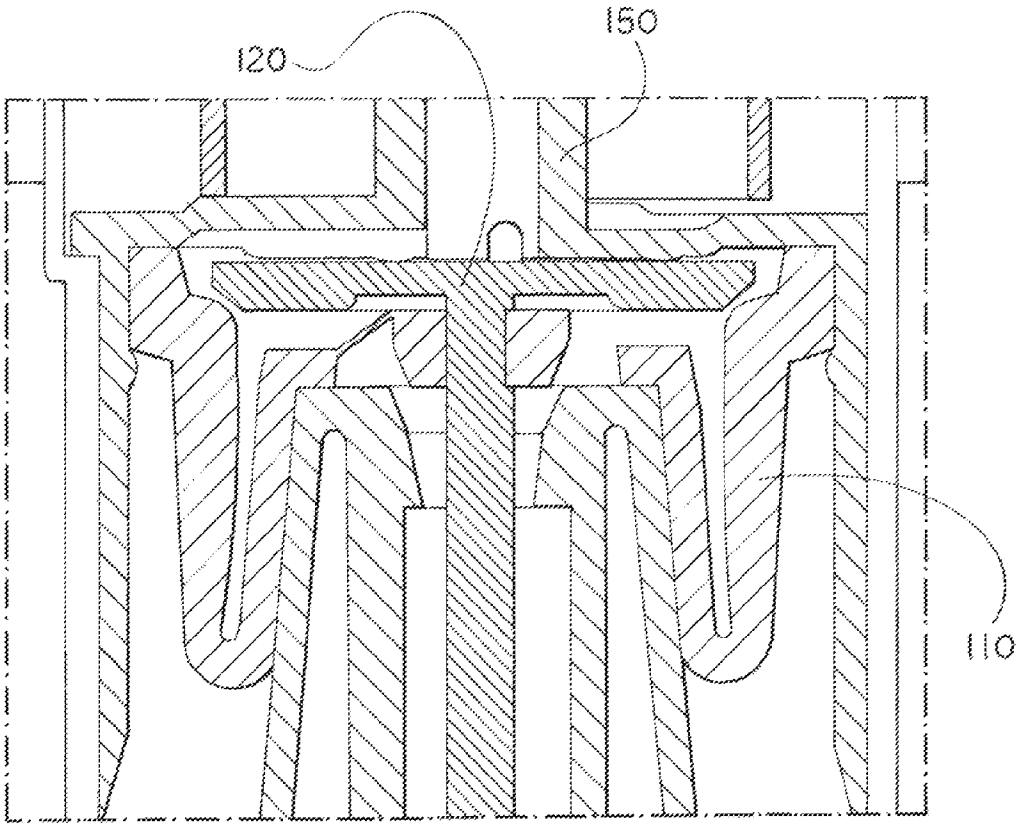

Upon release of the actuation force, the bellow 110 springs back to its original shape, pushing on the guide 150 and beginning to lift the guide 150 as illustrated in FIG. 10. As the bellow 110 moves the guide 150, the force on the stem 120 applied by the guide 150 is removed. Additionally, the bellow 110 again makes contact with the stem 120 such that the stem 120 and the bellow 110 are sealed to form a compartment or pump chamber between the stem 120 and an interior of the bellow 110. As the bellow 110 moves, the stem 120 is lifted by the bellow 110. The movement of the stem 120 unseats the suction valve 112 from the opening in the base 140. This creates a product flow path through the opening in the base 140 through which product may flow. Movement of the bellow 110 also forms a suction force which pulls product from a container through the opening in the base 140 and into the compartment or pump chamber.

The movement of the bellow 110 continues to draw product into the pump chamber until the bellow 110 reaches the at rest position. As the bellow 110 moves into the at rest position illustrated in FIG. 7, the fluid lock 130 is pulled by the stem 120 into contact with the opening in the base 140. The contact or seating of the fluid lock 130 on the opening of the base 140 seals the opening and prevents additional product from flowing into the pump chamber. The pump system 100 is then ready for another actuation.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. A pump system, comprising:

a base;

an opening in the base;

a bellow resting on the base, the bellow comprising a suction valve and an upper lip;

a stem comprising a top portion seated on the upper lip of the bellow, a neck extending through the suction valve, and an end portion extending through the opening in the base;

a fluid lock attached to the end portion extending through the opening in the base; and a tube connected to the base.

2. A pump system, comprising:

a base;

an opening in the base;

a bellow comprising a suction valve and an upper lip;

a stem comprising a top portion, a neck, and an end portion, wherein the top portion is configured to seat next to the upper lip of the bellow, the neck extends through the suction valve, and the end portion extends through the opening in the base; and a guide in communication with the bellow.

3. The pump system of claim 2, further comprising a container connected to the base.

4. The pump system of claim 3, wherein the container further comprises a container selected from the group consisting of a bottle, an airless bottle, a bag and a tube.

5. The pump system of claim 2, wherein the bellow comprises a material selected from the group consisting of silicon, TPE, TPU, and an elastomer.

6. The pump system of claim 2, further comprising a pump head.

7. The pump system of claim 2, further comprising an attachment mechanism.

8. The pump system of claim 2, further comprising a dip tube.

9. The pump system of claim 2, wherein the guide comprises a pump head.

10. The pump system of claim 2, further comprising a fluid lock attached to the end portion of the stem.

11. The pump system of claim 2, further comprising a tube connected to the base.

12. The pump system of claim 2, further comprising a container selected from the group consisting of a tube, bag, airless bottle, and bottle attached to the base.

* * * * *